US005859398A

United States Patent [19]

McKean

[11] Patent Number: 5,859,398

[45] Date of Patent: Jan. 12, 1999

[54] SEQUENTIAL ISOLATING CIRCUIT BREAKER AND ACTUATOR

[75] Inventor: Brian McKean, Ruddington, Great Britain

[73] Assignee: Brian McKean Associates Limited, Nottingham, United Kingdom

[21] Appl. No.: 693,093

[22] PCT Filed: Feb. 20, 1995

[86] PCT No.: PCT/GB95/00347

§ 371 Date: Aug. 16, 1996

§ 102(e) Date: Aug. 16, 1996

[87] PCT Pub. No.: WO95/22832

PCT Pub. Date: Aug. 24, 1995

[30] Foreign Application Priority Data

Feb. 18, 1994 [GB] United Kingdom ..... 9403143

[51] Int. Cl.[6] ..... H01H 33/14; H01H 33/12

[52] U.S. Cl. ..... 218/7; 218/10; 218/3

[58] Field of Search ..... 218/2, 3, 4, 6, 218/7, 10, 14, 118, 120, 140, 153, 154

[56] References Cited

U.S. PATENT DOCUMENTS 3,824,359 7/1974 Date ..... 200/146 R 4,166,938 9/1979 Peek ..... 200/153 G 4,484,046 11/1984 Neuhouser ..... 200/144 B 4,591,678 5/1986 Yin ..... 200/144 B

*Primary Examiner*—Ronald Stright, Jr.

*Assistant Examiner*—Michael J. Hayes

*Attorney, Agent, or Firm*—Fish & Richardson P.C.

[57] ABSTRACT

A circuit breaker comprises a vacuum interrupter and an isolator in series combination, the vacuum interrupter providing fast interruption of current and the isolator providing a large gap when in the open condition for additional safety and protection against transients. The circuit breaker may be operated by a single actuator device and is adapted to provide sequential isolation first by the vacuum interrupter, followed by the isolator to a fully open circuit condition, and on closing is adapted to first close the isolator under a no-load condition followed by closure of the vacuum interrupter to resume current flow. The isolator additionally provides for the single actuator device to slowly close the isolator with low force and to quickly close the vacuum interrupter with high force. An actuator mechanism also provides further control of the relative speeds of closure of the isolator and vacuum interrupter.

7 Claims, 8 Drawing Sheets

SEQUENTIAL ISOLATING CIRCUIT BREAKER AND ACTUATOR

The present invention relates to a circuit breaker incorporating a vacuum interrupter or switch in series combination with a sequential isolator.

Circuit breakers incorporating vacuum interrupters or switches are usually restricted to operating on three phase systems up to and including 36 kV. This is mainly because vacuum interrupters or switches are essentially short stroke devices in which the gap between the electrical contacts when the interrupter is open is usually between 10 and 20 mm. Such devices can normally withstand a maximum impulse voltage of approximately 200 kVp, which is the level typically required of 36 kV systems. Vacuum interrupters and switches for ratings of 36 kV are usually much more expensive than devices rated at, for example, 12 kV because of the difficulty in meeting the higher impulse voltage standards required.

Another feature of vacuum interrupters and switches is that the moveable and fixed contacts are, in general, of the "butt" type. These must be pressed together, both when closing and when fully closed, with sufficient force to be able to withstand the electromagnetic repulsive forces particularly when operating under maximum fault conditions when the forces generated can be considerable.

A solution to the above problems has been to provide a circuit breaker which combines a vacuum interrupter in series with an isolator, in which the isolator provides very much greater contact-to-contact distance when in the open condition.

In various prior art systems, two separate actuating mechanisms are required to support such circuit breakers: a first, short stroke, actuator to actuate the vacuum interrupter or switch, and a second, long stroke, actuator to actuate the isolator. Actuators are typically electromagnetic devices chosen to meet the particular requirements of the system to be operated with respect to speed of operation, holding force, stroke length etc. With two actuators, as indicated above, an electronic control system is then required to ensure correctly linked operation of the two devices or alternatively the isolator maybe a manually operated device. Duplication of actuators, whilst providing actuators which can individually be matched to the requirements of both the vacuum interrupter and isolator, nevertheless increases cost and complexity.

It is desirable to provide a "common" mechanical control mechanism which can operate both the vacuum interrupter and the isolator. For the avoidance of doubt, the expression "common mechanism" is used to indicate that a single actuator is adapted to operate both the vacuum interrupter and the isolator. To do this, a number of problems must be overcome.

Firstly, to ensure optimum operation of the circuit breaker, it is preferable for the current to be both interrupted and resumed by the action of the vacuum interrupter, and not by the isolator; in other words, the isolator is preferably an "off-load" device, only opening or closing when the vacuum interrupter has already operated in the appropriate direction.

This prevents damage to the contacts of the off-load isolator which, being an inherently larger device and not having vacuum isolation between opening contacts, is slower to operate and more prone to arcing or electrostatic discharge damage such as pitting of the contacts. Thus it is preferred that the actuating mechanism should, from a closed circuit condition, firstly open the vacuum interrupter rapidly, and then open the off-load isolator. Conversely, from the open circuit condition, it is preferable that the actuating mechanism first close the off-load isolator, and then close the vacuum interrupter. Such a facility is not found, for example, in the prior art switch assembly of GB-2 217 916 which fails to close the isolator ("disconnector") prior to closing the vacuum interrupter.

Secondly, prior art systems have not solved another particular difficulty with common actuating mechanisms adapted to operate both the vacuum interrupter and off-load isolator. As has been stated earlier, vacuum interrupters and isolators have entirely different characteristics. A vacuum interrupter may have contacts which, when open, are only 8 mm or so apart, and the contactor should operate at high speed, for example moving at 1 m/s to fully open or close in approximately 8 msec. Thus, considerable driving and holding force is applied to operate the vacuum interrupter at the requisite speed, and to maintain the contacts in a closed condition. Such forces are entirely inappropriate for off-load isolators which, if subjected to such forces, will inevitably degrade from impact damage and thus fail quite rapidly, particularly in view of their larger size and distance of travel.

It is therefore an object of the present invention to provide a common mechanical actuating mechanism which is capable of automatically actuating both a vacuum interrupter and an off-load isolator in the correct sequence of operation as indicated above.

It is a further object of the present invention to provide a common mechanical actuating mechanism which is capable of actuating both a vacuum interrupter and an off-load isolator with a speed and driving force characteristic which is appropriate to each device.

It is a further object of the invention to provide a common actuating mechanism which can operate both single and three phase supplies with a reduced energy requirement.

In accordance with one embodiment of the present invention, there is provided a sequential isolating circuit breaker comprising a vacuum interrupter and an isolator device in series combination between two terminal connections, a single actuator drive link coupled to the vacuum interrupter and to the isolator via an end mechanism, wherein:

- upon operation of the actuator drive link to close the circuit breaker, the end mechanism is adapted to firstly close a contactor of the isolator and subsequently to close a contactor of the vacuum interrupter; and
- upon operation of the actuator drive link to open the circuit breaker, the end mechanism is adapted to firstly open the contactor of the vacuum interrupter and subsequently to open the contactor of the isolator.

The present invention further provides an actuator mechanism for a sequential isolating circuit breaker, having a drive link for connecting to a circuit breaker, the actuator mechanism including means to move the drive link in three successive phases of operation, and comprising:

- first phase means adapted to move the drive link in a first direction at a relatively slow speed;
- second phase means adapted to continue to move the drive link in the first direction, but at a relatively fast speed; and
- third phase means adapted to move the drive link in a second direction, opposite to the first direction, at a relatively fast speed to return the drive link to its starting position.

The present invention will now be described in detail, by way of example, with reference to the accompanying drawings in which:

FIGS. 1(*a*), 2(*a*) and 3(*a*) show schematic side views of a common actuator and end mechanism in three respective stages of operation in accordance with a first embodiment of the present invention, while corresponding FIGS. 1(*b*), 2(*b*) and 3(*b*) show schematic side views of the end mechanism in greater detail;

Figure 8A:
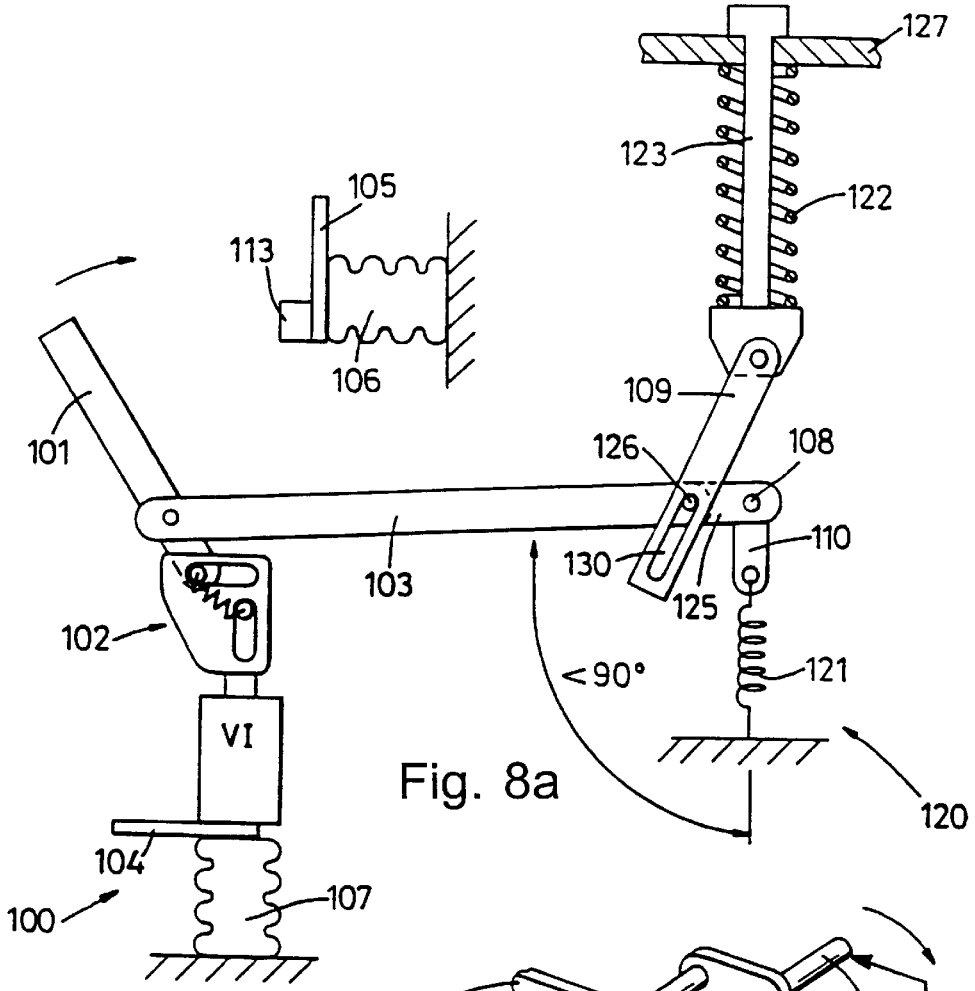
Figure 8B:
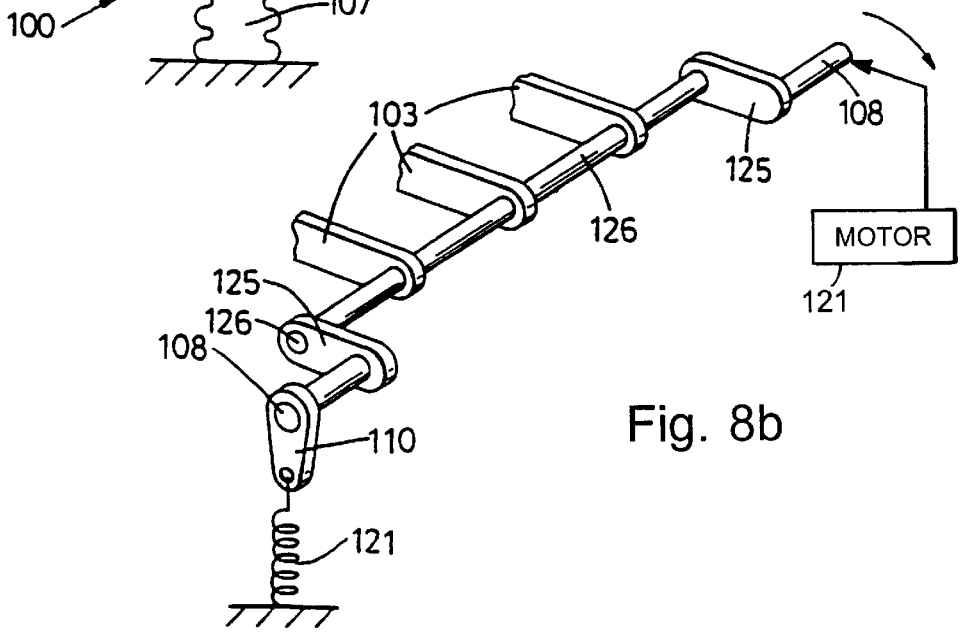
Figure 10A:
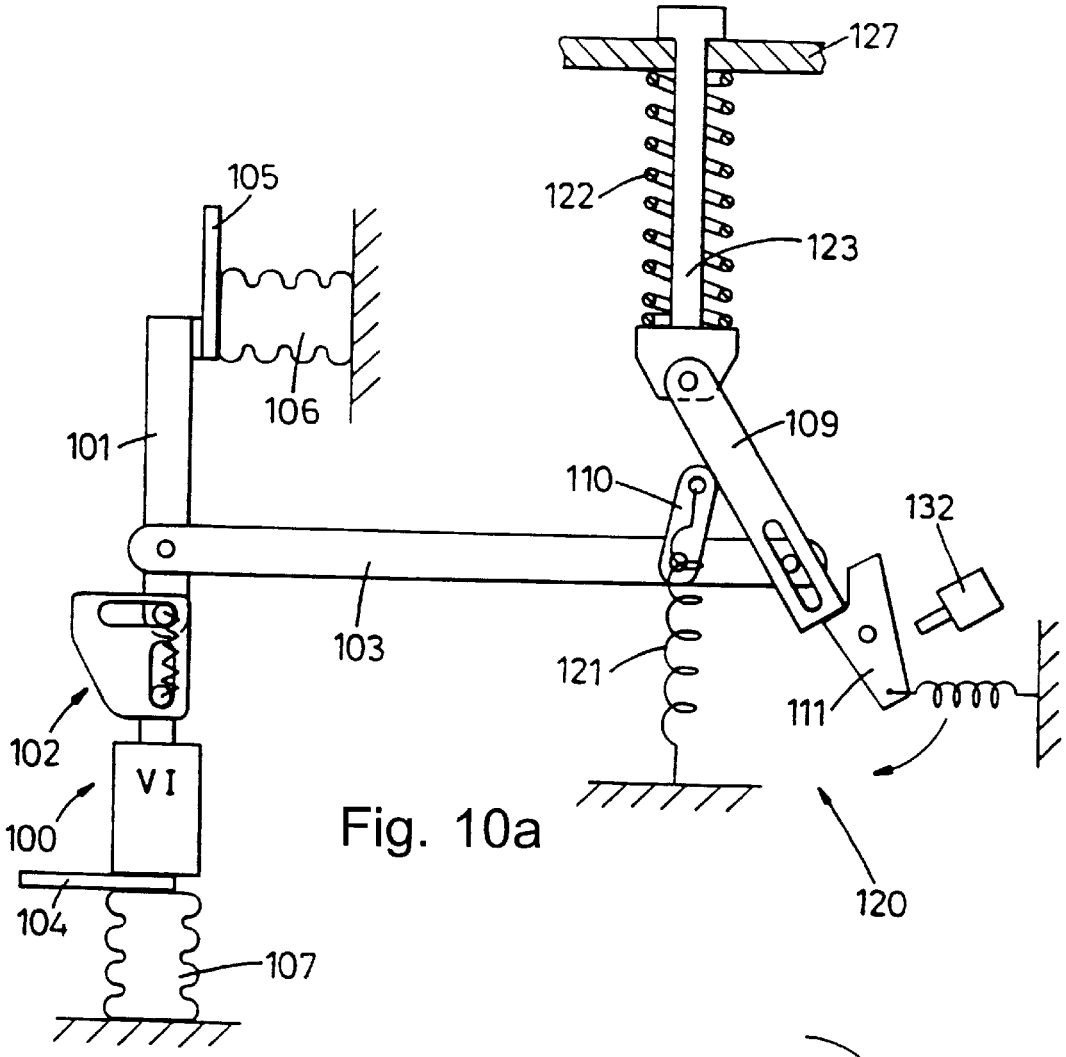
Figure 10B:
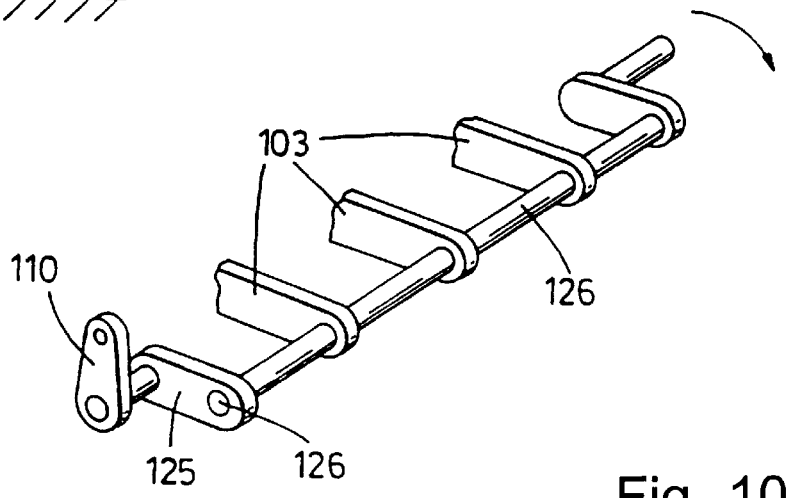
Figure 11A:
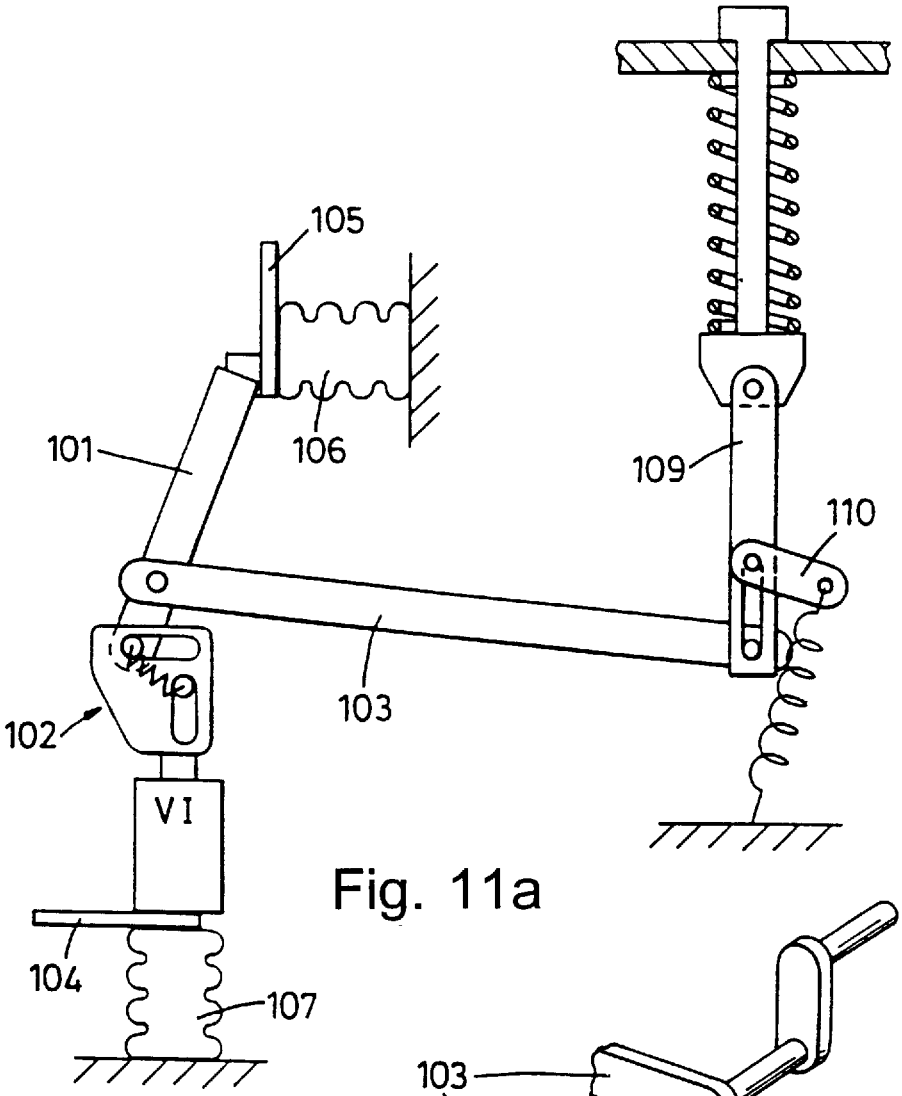
Figure 11B:
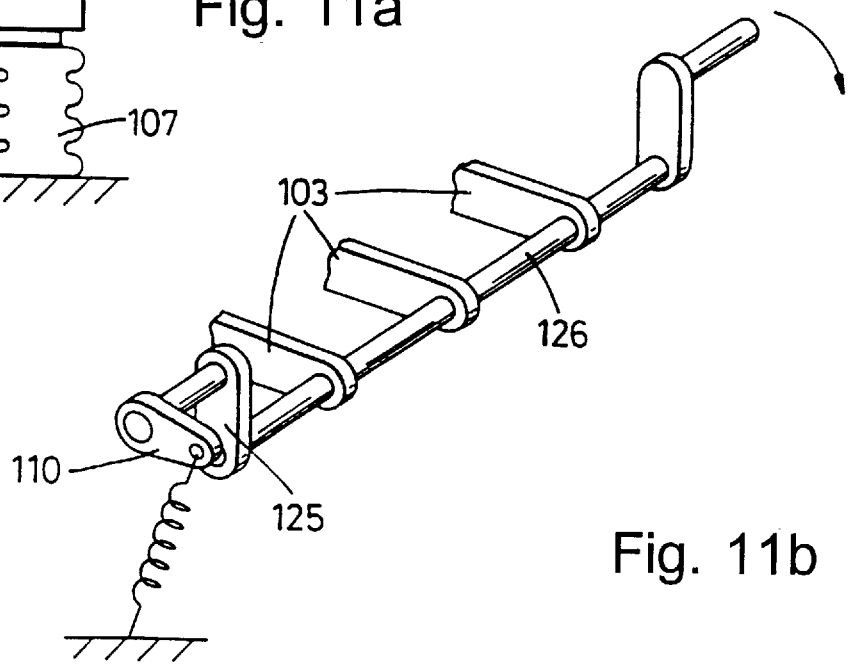
Figure 12:
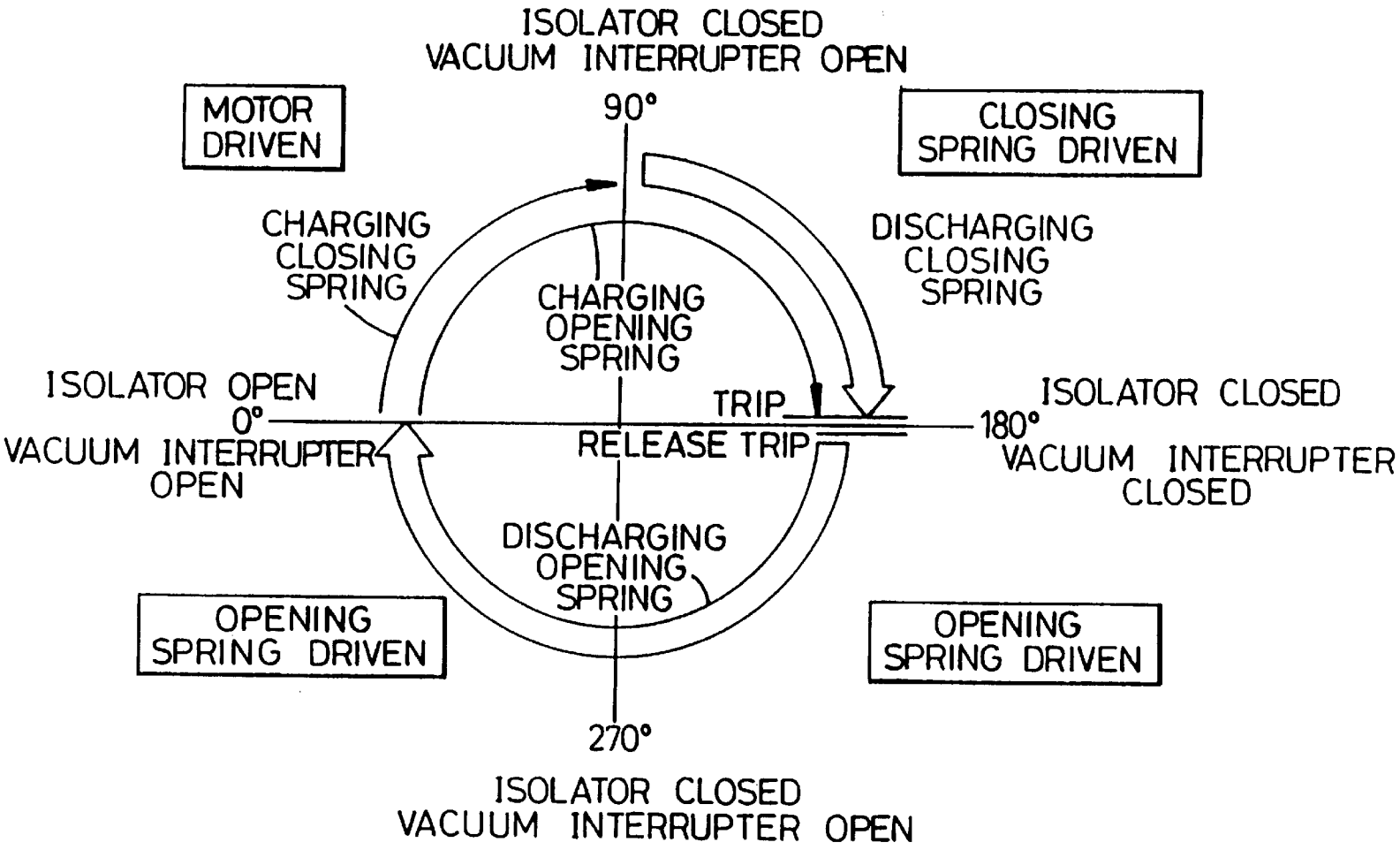

FIGS. 8(*a*), 9(*a*), 10(*a*) and 11(*a*) show schematic diagrams of an end view of a motor drive actuating mechanism suitable for operating the drive link of the actuator of FIGS. 1 to 6, while corresponding FIGS. 8(*b*), 9(*b*), 10(*b*) and 11(*b*) show additional detail in a perspective view; and FIG. 12 shows a diagram of the phases of operation of the motor drive actuating mechanism of FIGS. 8 to 11.

Figure 1A:
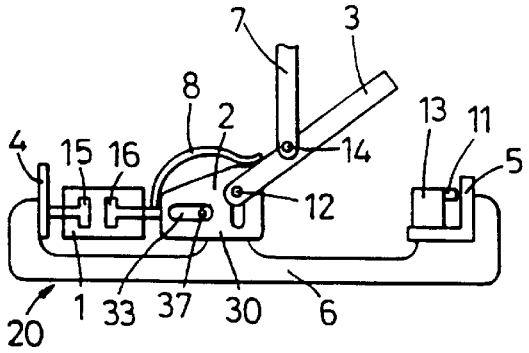
Figure 1B:
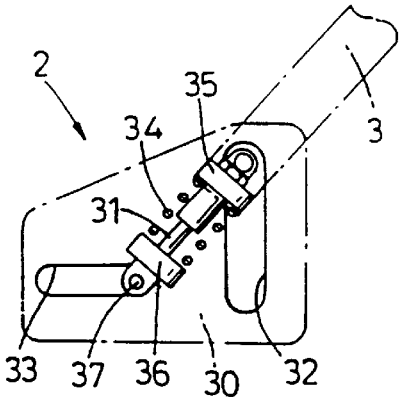
Figure 2A:
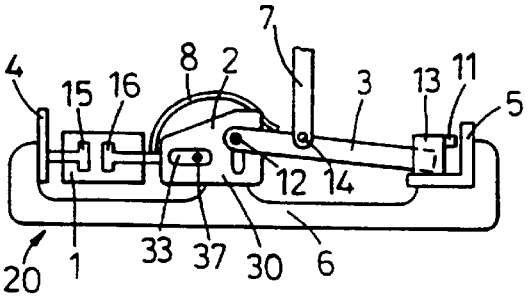
Figure 2B:
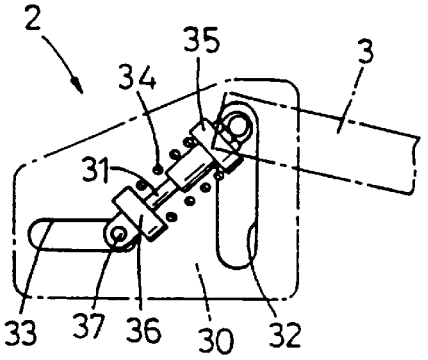

With reference to FIGS. 1(*a*), 2(*a*) and 3(*a*), there is shown a presently preferred embodiment of a circuit breaker according to the present invention. FIG. 1(*a*) shows the circuit breaker in its fully open condition; FIG. 2(*a*) shows the circuit breaker in its partially closed condition, ie. with isolator closed, and vacuum interrupter still open; and FIG. 3(*a*) shows the circuit breaker in fully closed condition.

FIGS. 1(*b*), 2(*b*) and 3(*b*) show the detail of the end mechanism corresponding to the condition of the circuit breaker in the corresponding FIGS. 1(*a*), 2(*a*) and 3(*a*).

Circuit breaker 20 comprises an electrically insulating substrate 6 upon which are mounted first and second terminal connectors 4,5 for making external connections to the circuit breaker. The first terminal connector 4 is coupled to a first, non-moving, terminal 15 of a vacuum interrupter 1 of known type. The second, moving contactor, terminal 16 of the vacuum interrupter 1 is attached to an end mechanism 2 to be described hereinafter, and is also electrically connected to a contactor embodied herein as an isolator arm or blade 3 via a flexible electrical connection 8. The isolator arm 3 is pivotally attached at a first end thereof, at pivot 12, to the end mechanism 2. The second end of the isolator arm 3 is adapted to engage with a contactor slot 13 which preferably comprises two side walls parallel to the plane of the drawings which are biassed inwardly toward one another to grip the arm 3 providing the necessary physical contact to electrically connect the arm 3 to terminal connector 5. An upper flange 11 projects from the contactor slot both inwardly and away from the arm 3 from at least one of the side walls of contactor slot 13. The isolator arm 3 is pivotally coupled, at pivot 14, to an insulated actuator drive link 7. The pivot 14 is positioned between the first and second ends of the arm 3 at a location to be determined with reference to various geometrical considerations as will become apparent infra.

The end mechanism 2 is shown in FIG. 1(*b*), in cross section, through approximately the longitudinal centre-line (parallel to the plane of the drawing) of the circuit breaker 20 of FIG. 1(*a*). Its support plate 30 as viewed in FIG. 1(*a*) is shown in dotted outline, together with the isolator arm 3.

The end mechanism 2 comprises a telescopic rod 31 pivotally coupled at a first end thereof, by pivot 12, to the isolator arm 3 which is constrained to move, together with the first end of the isolator arm 3, within a vertical slot 32 in the support plate 30. The second end of the telescopic rod 31 is pivotally attached, at pivot 37, to the moving contactor of the vacuum interrupter 1, which pivot 37 is constrained to move within longitudinal slot 33 in support plate 30*a*. The telescopic rod 31 is biassed to its extended configuration by a co-axial spring 34 bearing against inner surfaces of upper and lower flanges 35,36 of the rod 31.

Figure 3A:
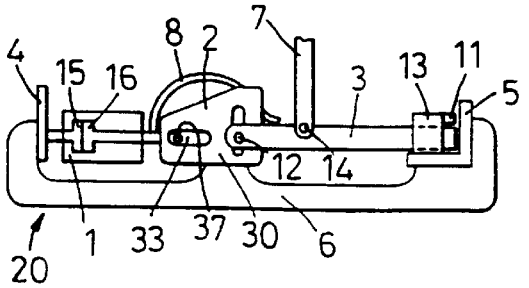
Figure 3B:
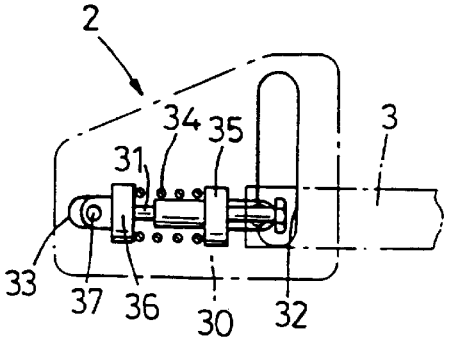

The operation of the circuit breaker will now be described with reference to FIGS. 1 to 3. From a fully open condition (both vacuum interrupter and isolator open) as shown in FIGS. 1(*a*) and (*b*), the drive link 7 (driven by an actuator, not shown) bears down on the isolator arm 3 with sufficient force to enable it to pivot about the first end (pivot 12) and to engage with contactor slot 13. The spring bias from spring 34 is sufficient to prevent any downward movement of the pivot 12 at this stage. Upon completion of this first stage, the isolator arm has closed the isolator circuit, and the circuit breaker is in the condition as shown in FIGS. 2(*a*) and 2(*b*).

Further downward travel of the drive link 7 causes the pivot 12, and thereby the first end of the arm 3, to be driven down the vertical slot 32. This has two effects: firstly the arm 3 is pushed slightly sideways in the right hand direction as viewed in FIG. 2(*a*), thereby causing the arm 3 to latch beneath flange 11; and secondly the telescopic rod 31 drives the pivot 37 leftwards within longitudinal slot 33 thereby pushing the moving contactor 16 (FIGS. 2(*a*) and 3(*a*)) against fixed contact 15 of the vacuum interrupter 1. Upon collision of the fixed contact 15 and the contactor 16, overtravel of the pivot 12 to near the bottom of vertical slot 32 is absorbed by telescopic rod 31 and spring 34 to provide the necessary contact force required for the vacuum interrupter 1. The reaction to the contact force is provided longitudinally through the circuit breaker 20, via telescopic rod 31, arm 3 and an end stop at terminal connector 5, as shown in FIGS. 3(*a*) and 3(*b*), the circuit breaker thereby reaching a closed, bistable state without provision of significant holding force by the drive link 7.

To open the circuit breaker, the drive link 7 is retracted in an upward direction, lifting arm 3. The second end of arm 3 is initially held down by flange 11 while the drive link upsets the stable state of the circuit breaker, providing an initial impetus for spring 34 to ensure that the first end of arm 3 is rapidly pushed upward to the condition shown in FIGS. 2(*a*) and 2(*b*). Continued upward movement of the drive link 7 completes the lifting of arm 3 to the fully open, bistable condition of the circuit breaker 20.

Figure 4:
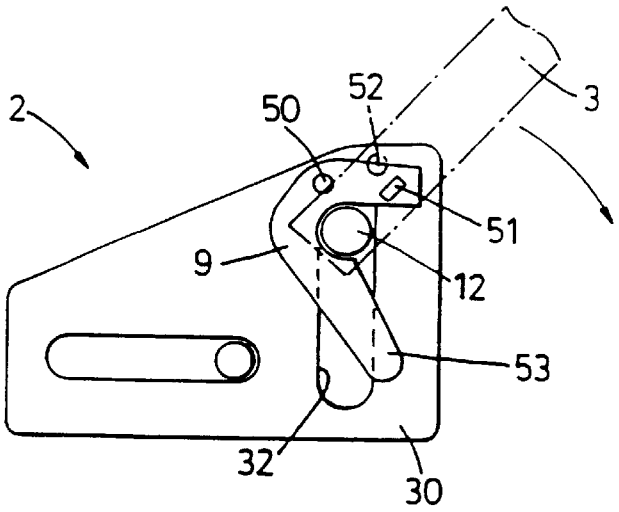
FIGS. 4, 5 and 6 show schematic side views of an end mechanism latch in each of the three positions corresponding to FIGS. 1, 2 and 3.
Figure 5:
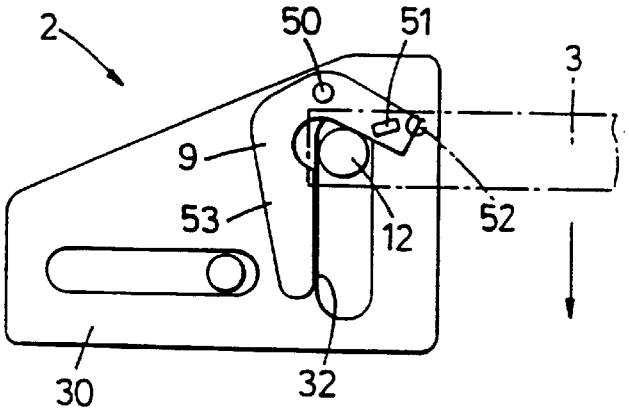
Figure 6:
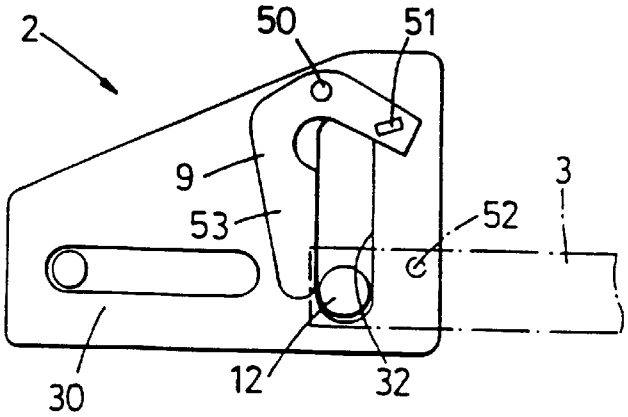

It will be understood that the embodiment described supra relies upon a resistance to downward motion of pivot 12 which is greater than the resistance of the arm 3 engaging into contactor slot 13. This could be provided in a number of ways, but most reliably, could be ensured by an appropriate interlocking device. With reference to FIGS. 4 to 6, there is described an exemplary such interlocking device.

Coupled to the front plate 30 and/or back plate (not shown) of end mechanism 2 is an interlock lever 9 which is pivotable about pivot 50. A lug 51 protrudes laterally towards the isolator arm 3 (ie. projecting out of the plane of the figure), which carries a corresponding lug 52 projecting from the isolator arm toward the interlock lever 9 (ie. into the plane of the figure). The lugs 51,52 collide and thereby co-operate to cause the interlock lever 9 to rotate about pivot 50 when the isolator arm 3 is rotating about pivot 12, the lugs 51,52 finally clearing one another when the isolator arm 3 has reached its closed position (FIG. 5). At this stage, the interlock lever 9 has rotated sufficiently far for an interlock arm 53 to have cleared vertical slot 32, thereby allowing pivot 12 to descend in manner already described with reference to FIGS. 1 to 3.

Figure 7A:
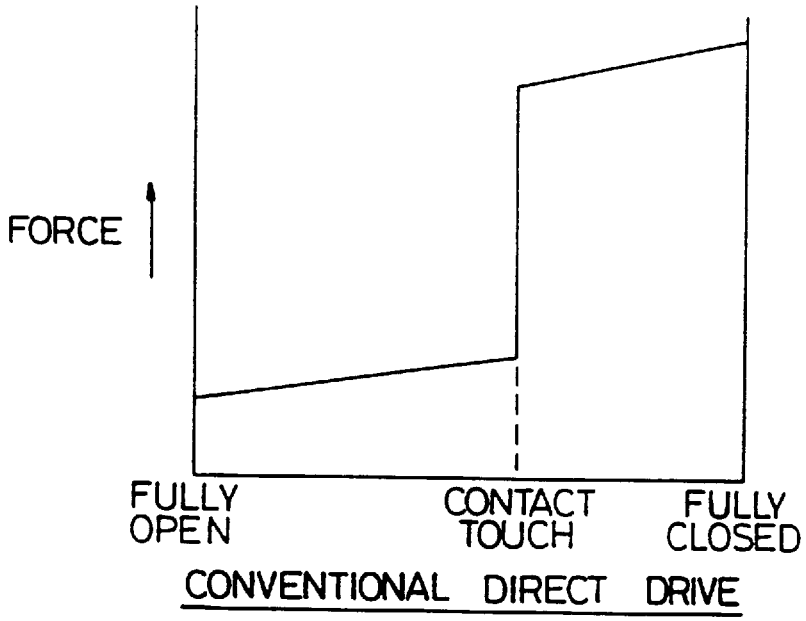
FIG. 7 shows a force vs. travel distance diagram comparing the operation of a prior art isolator actuator with that of one embodiment of the present invention.
Figure 7B:
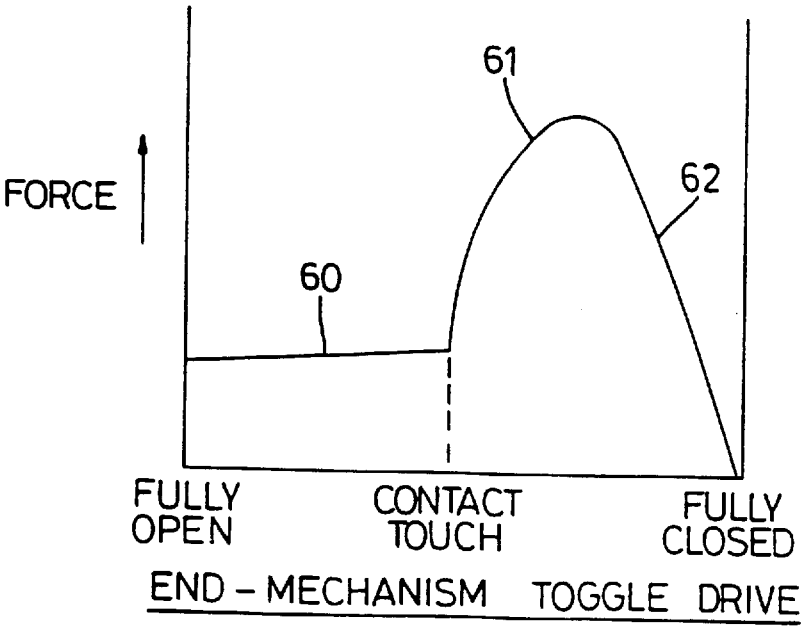

Some of the advantages of the mechanism described above are exemplified by the force vs. travel distance diagram shown in FIG. 7(*b*). The y-axis shows the force applied to drive link 7 in order to obtain the closure of the circuit breaker. An initial low force portion 60 is required to close the isolator arm, the force then rising sharply (portion 61) to overcome the location of the arm 3 into contactor slot 13 followed by the overcoming of the spring bias as the vacuum interrupter contactor closes. The force then drops to zero as the circuit breaker mechanism locks into its closed, bistable position. By contrast, a typical prior art system is shown in FIG. 7(*a*).

It will be understood, from the above description, that the circuit breaker provides an isolator contactor arm 3 which is pivotable about a first end thereof (at pivot 12) to subtend a first arc of first magnitude to open or close the isolator, and is also pivotable about an opposite, second end thereof (at contactor slot 13) to subtend an arc of second magnitude which movement is harnessed, through the end mechanism, to open or close the vacuum interrupter. By arranging the pivoting action through each of the first and second arcs to be generally sequential and non-commutative (ie. the first arc is subtended before the second arc in the closing operation, and the second arc is subtended before the first arc in the opening operation), the advantage of correct sequencing of the vacuum interrupter and off-load isolator is achieved.

It will be understood from the above description that by varying the geometry of the circuit breaker, additional control over the relative speeds of opening and closure of the vacuum interrupter 1 and the isolator contactor arm 3 can be achieved. By positioning the pivot 14 further towards the contactor slot 13, for a given travel speed of the drive link 7, the arm 3 will close more slowly, and the vacuum interrupter contactor 16 will travel more quickly. Suitable adjustment of the angle of the telescopic rod 31 when it is in its home position (FIG. 1(*b*)) will enable variation in the relative speed of movement of contactor 16.

In certain circumstances, the variability in the adjustment of the relative speeds of closure is not sufficient when derived from the geometrical considerations alone. For example, where a very large gap is required in the isolator, or extremely fast operation of the vacuum interrupter is required, the above design considerations may not be able to provide the necessary specifications. Such situations arise where, for example, on a high voltage system, the isolator is open to outdoor, moisture-laden atmosphere. This environment requires a much larger gap between the isolator arm 3 and the contactor slot 13 when in open condition for required levels of safety. Normally, such isolating arms would be in a sealed unit providing a controlled low conductivity environment having high dielectric breakdown strength, eg. filled with $SF_6$ gas. In a typical indoor use, on a 36 kV system, the vacuum interrupter may have a gap of 8 mm in contrast with an isolator gap of 90 mm. For outdoor use, a safe minimum for the isolator gap would, however, be in the region of 300 to 350 mm.

However, the problem of larger gaps can be solved by introducing a more sophisticated, single actuator coupled to drive link 7, an example of which will now be described.

With reference to FIGS. 8, 9 10 and 11, there is shown an exemplary mechanical actuator which provides the function of closure of the isolator arm 3, over a relatively large distance, at a relatively slow speed, followed by rapid, high force closure, over a short distance, of the vacuum interrupter 1. In a reverse operation, the actuator enables rapid opening of the vacuum interrupter, followed by opening of the isolator arm 3.

With reference to FIG. 8, there is shown schematically a circuit breaker 100, broadly in accordance with the circuit breaker 20 described in connection with FIGS. 1 to 6. An isolator arm 101 is coupled to end mechanism 102 and vacuum interrupter VI in manner already described. First terminal connector 104 is mounted onto a suitable substrate by an insulator block 107. Second terminal connector 105 and contactor slot 113 are also mounted to a suitable substrate by an insulator block 106.

The isolator arm 101 is coupled to an actuator mechanism 120 via drive link 103. The actuator mechanism is shown as an end view in FIG. 8(*a*), and parts of it are shown as a perspective view in FIG. 8(*b*).

The actuator mechanism 120 comprises an axle 108 which is driven in a clockwise direction by a motor 121 and gear box (not shown) driven through a clutch mechanism well known in the art (also not shown). The clutch mechanism allows the clockwise axle rotation to temporarily accelerate ahead of the motor rotation, but prevents the axle from lagging behind the motor rotation, for reasons which will become clear. In the arrangement schematically depicted, the motor would preferably drive at the far end of the axle 108.

Fixed to axle 108 is a crank 125 which is connected to a shaft 126 which shaft is axially offset from the axle 108. At least one drive link 103 is pivotally connected to the axially offset shaft 126. (Three drive links 103 are shown in FIG. 8(*b*): one each of these may be used to simultaneously drive three circuit breakers for use in a three phase application.)

An opening spring crank 110 projects downwards from the axle 108. The distal end of the crank 110 is coupled to an opening spring 121, the other end of which spring is connected to a suitable substrate. A closing spring 122 shown in cross-section is positioned top dead centre above axle 108, attached at its upper end to a fixed support 127, and adapted to compress upwards about a sliding shaft 123. A slotted link 109 connects the lower end of the closing spring 122 to the offset shaft 126. The slotted link 109 is pivotable about the lower end of the closing spring 122, and about the offset shaft 126, intercepting the offset shaft at a suitable location, eg. behind crank 125 as viewed in FIG. 8(*b*), but in front of drive link 103. The offset shaft is free to slide up and down the slot 130 of slotted link 109. In the "home" position (both vacuum interrupter and isolator arm open), the actuator mechanism is adapted so that drive link 103 is at an angle to the opening spring crank 110 of slightly less than 90°, for example 80°–85°.

The operation of the actuator 120 is as follows. Starting from the position in FIGS. 8(*a*) and 8(*b*), in which both the isolator arm 101 and the vacuum interrupter 104 are open, a close signal energises the motor which rotates the axle 108 in a clockwise direction. This rotation drives crank 125 round thus closing isolator arm 101 by means of drive link 103. Simultaneously, crank 125 drives slotted link 109 to compress the closing spring 122 against fixed support 127. Once the axle has rotated through 90°, the closing spring 122 is fully charged; the isolator arm 101 is closed; and the crank 110 has partially charged the opening spring 121. This configuration is shown in FIGS. 9(*a*) and 9(*b*).

Figure 9A:
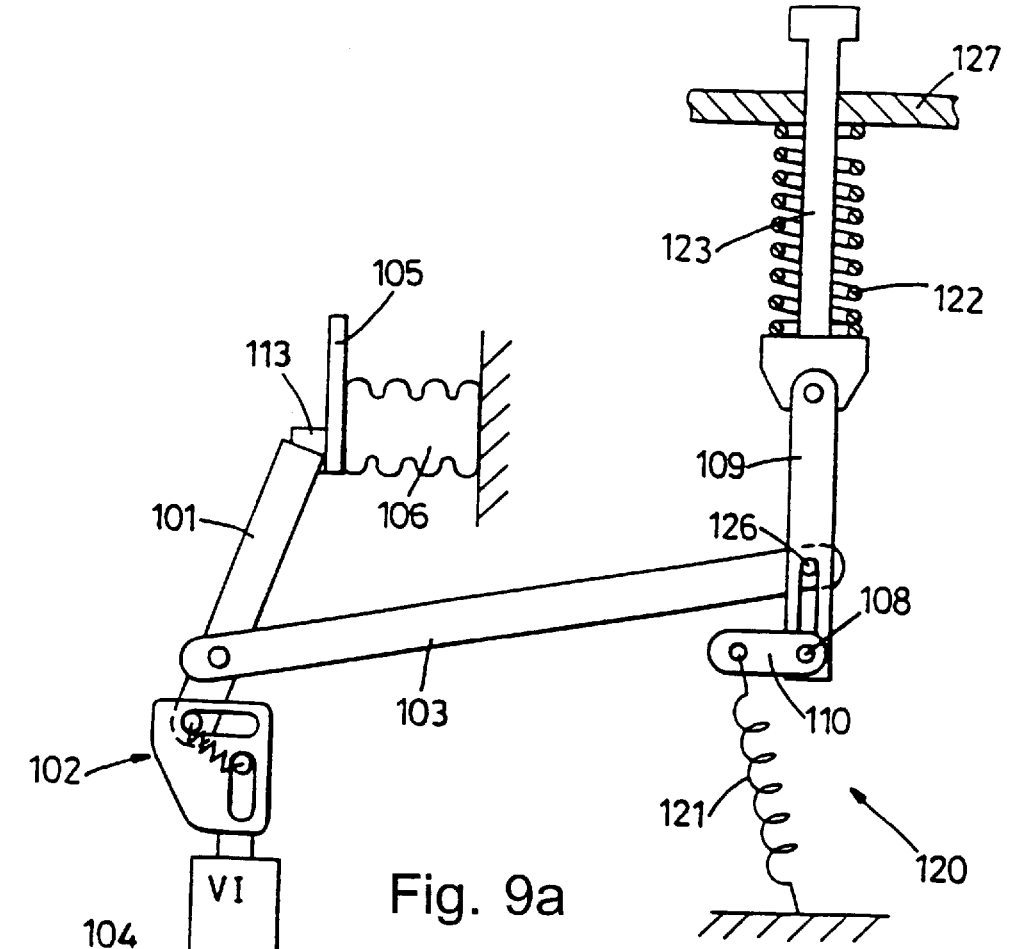
Figure 9B:
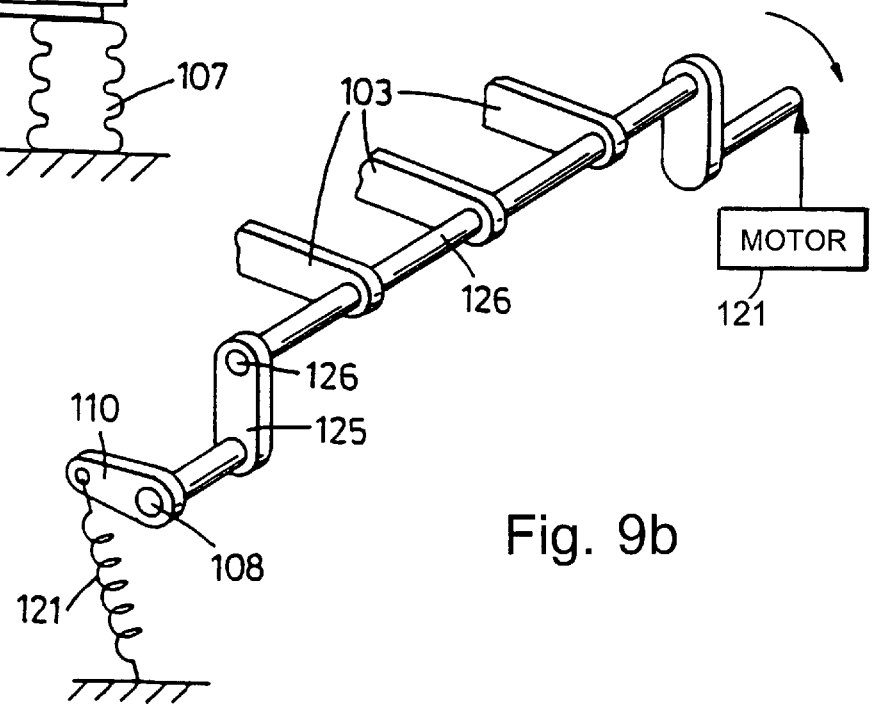

From the position shown in FIGS. 9(*a*) and 9(*b*), the closing spring 122 is able to rapidly discharge, rotating axle 108 ahead of the motor; driving slotted link 109 downward and to the right thereby closing vacuum interrupter VI suitably quickly and with the required force; fully charging opening spring 121 via crank 110 which is driven very slightly past top dead centre position as shown in FIGS. 10(*a*) and 10(*b*). The rotation of the axle 108 is halted slightly past the 180° position by slotted link 109 colliding with a stop member 111. At this point (or slightly earlier), the motor is switched off using a microswitch suitably triggered in manner well known in the art. Note that crank 125 is omitted from FIGS. 9(*a*), 10(*a*) and 11(*a*) in order to illustrate the position of slotted link 109 behind.

The circuit breaker 100 and actuator 120 will now remain in this position until a signal is provided to initiate opening of the circuit breaker. As has already been discussed, it is desirable that the vacuum interrupter initially opens quickly for both safety reasons and to minimize damage to the contactors in the vacuum interrupter. This rapid opening is provided by the stored energy in opening spring 121. The signal to open the circuit breaker initially trips the stop member 111 using a solenoid trip coil 132. The opening spring 121 discharges by rotating axle 108 by means of the torque applied to crank 110, displacing drive link 103 sufficiently far to the left to open the vacuum interrupter VI, which is achieved at the position approximately 270° from the beginning of the cycle. This position is shown in FIGS. 11(*a*) and 11((*b*). The opening spring will continue to discharge, to open the isolator arm 101, finally achieving the position shown in FIGS. 8(*a*) and 8(*b*).

It will be observed that with this particular embodiment, the isolator arm is closed slowly, at a speed determined by the motor, but may be opened faster, at a speed determined by the remaining charge left in opening spring 121. This confers additional benefits, since it is only rapid closing of the isolator arm which renders it susceptible to damage from the collision with the contactor slot 113. Upon opening, no such collision can occur, and although the vacuum interrupter has already opened the circuit breaker, the sooner the large gap provided by the isolator arm is achieved, the greater the safety of the circuit breaker. It will also be noted that there may be some residual charge left in the closing spring upon initiation of the opening action which increases the speed of opening the vacuum interrupter, but which is dissipated before the opening of the isolator.

It will also be observed that the actuator can be constructed to fail safe under control power loss; The stop member 111 may be alternatively constructed so that solenoid trip coil 132 biasses stop member to the stop position shown in FIG. 10(*a*) when energised against a suitably positioned spring. When power to the solenoid trip coil is lost, the spring trips open the stop member, allowing opening of the circuit breaker 100 under stored spring energy only. Control power is only required to close the circuit breaker.

It will also be observed that actuator mechanism can be adapted to drive all three phases of a three-phase power supply, thus reducing the control power required over prior art systems employing three actuators.

In summary, the action of the actuator 120 is as shown diagrammatically in FIG. 12. Starting with a "home" position of 0° (vacuum interrupter open; isolator arm open), a first rotation to 90° is made slowly under motor power to a position in which the vacuum interrupter remains open; the isolator arm has slowly closed; and the opening spring is fully charged. Continued rotation to the 180° position is rapidly effected under power of the opening spring, which achieves the position in which the vacuum interrupter has rapidly closed; the isolator arm has remained closed; the closing spring has discharged; the opening spring has fully charged; and the actuator has achieved a stable spring biassed state against the stop member 11. Upon release of the stop member 111, the opening spring rapidly rotates the system to the 270° position in which the vacuum interrupter has rapidly opened; the isolator arm remains closed; and the opening spring has partially discharged. The final stage of the rotation to 360° is also achieved under the power of the opening spring to the fully open position in which both the vacuum interrupter and the isolator arm are opened.

I claim:

1. A sequential isolating circuit breaker comprising a vacuum interrupter and an isolator in series combination between two terminal connections, a single actuator drive link coupled to the vacuum interrupter and to the isolator via an end mechanism, wherein said actuator drive link and said end mechanism are arranged so that:

upon operation of the actuator drive link to close the circuit breaker, the end mechanism first closes a contactor of the isolator and subsequently closes a contactor of the vacuum interrupter; and upon operation of the actuator drive link to open the circuit breaker, the end mechanism first opens the contactor of the vacuum interrupter and subsequently opens the contactor of the isolator;

and wherein:

the isolator contactor comprises an arm which is pivotable about a first end thereof to subtend a first arc of first magnitude to open or close the isolator, and pivotable about an opposite, second end thereof to subtend an arc of second magnitude, the magnitude of the first arc being greater than the magnitude of the second arc and the pivoting action through each of the first and second arcs being generally sequential;

the actuator drive link being directly coupled to the arm such that movement of the arm through said arc of second magnitude causes said opening or closing of the vacuum interrupter, the positioning of the coupling of the actuator drive link to the arm determining the relative speed with which the isolator contact and the vacuum interrupter contact close.

2. A circuit breaker according to claim 1 wherein the distance travelled by the contactor of the isolator is greater than the distance travelled by the contactor of the vacuum interrupter.

3. A circuit breaker according to claim 1 or claim 2 wherein the end mechanism closes and opens the contactor of the vacuum interrupter at a higher speed than that at which it opens and closes the contactor of the isolator.

4. A circuit breaker according to claim 1, claim 2 or claim 3 wherein the end mechanism provides a force to close the vacuum interrupter contactor which is greater than the corresponding force to close the isolator contactor.

5. A circuit breaker according to claim 1 further including means to substantially prevent simultaneous pivoting through the first and second arcs.

6. A circuit breaker according to claim 3, claim 4 or claim 5 wherein upon closure of the arm, the actuator drive link applies substantially no force to the arm to maintain the contactor of the vacuum interrupter and the contactor of the isolator closed.

7. A circuit breaker according to claim 6 wherein upon closure of the arm, by movement thereof in a first direction, the end mechanism and arm provide, from the movement of the actuator drive link in the first direction, a closure movement of the vacuum interrupter contactor in a second direction transverse to the first direction.

* * * * *